US011060815B1

(12) United States Patent
Novak

(10) Patent No.: US 11,060,815 B1
(45) Date of Patent: Jul. 13, 2021

(54) ACCESSORY RAIL KIT

(71) Applicant: U.S. Army Space and Missile Defense Command, Huntsville, AL (US)

(72) Inventor: Justin R. Novak, Harvest, AL (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 53 days.

(21) Appl. No.: 16/594,711

(22) Filed: Oct. 7, 2019

(51) Int. Cl.
*F41G 11/00* (2006.01)
*F41C 27/00* (2006.01)

(52) U.S. Cl.
CPC ..... *F41C 27/00* (2013.01); *F41G 11/003* (2013.01)

(58) Field of Classification Search
CPC ..... F41C 27/00; F41C 23/16; F41C 23/12; F41G 11/003; F41G 11/004; F41G 1/38; F41A 3/66
USPC ..... 42/124, 111, 71.01, 90
See application file for complete search history.

(56) References Cited

U.S. PATENT DOCUMENTS 5,941,489 A 8/1999 Fanelli et al.
7,571,562 B2 8/2009 Sutherby
8,104,218 B2 1/2012 McCann
8,146,283 B2 * 4/2012 Genes ..... F41G 11/003 42/90
8,336,247 B2 12/2012 Haering
8,683,909 B1 * 4/2014 Copus ..... F41A 23/16 89/37.04
9,151,575 B2 10/2015 Pereira
9,157,696 B2 10/2015 Dextraze
9,618,302 B2 4/2017 Kintzing
9,784,529 B1 * 10/2017 Angle ..... F41C 27/22
10,107,596 B2 10/2018 Greenwood
2009/0101776 A1 * 4/2009 Peterson ..... F41G 11/001 248/205.1
2011/0100203 A1 * 5/2011 Genes ..... F41H 5/12 89/9
2013/0061508 A1 * 3/2013 Nelson ..... F41A 23/16 42/94
2015/0253104 A1 9/2015 Holland
2019/0226797 A1 * 7/2019 Faifer ..... F41C 27/22

* cited by examiner

*Primary Examiner* — Michael D David
(74) *Attorney, Agent, or Firm* — C. Joan Gilsdorf

(57) ABSTRACT

An accessory rail kit removably mountable on a weapon. The accessory rail kit includes an upper accessory rail extending parallel to a round of the weapon. The upper accessory rail has a front end, a back end, and an upper accessory mounting surface. A base supports the upper accessory rail. A front structural support extends downwardly from the base, proximate to the front end of the upper accessory rail, and engages the weapon. A back structural support extends downwardly from the base, proximate to the back end of the upper accessory rail, and engages the weapon. A side rail support extends downwardly from a right side of the base that engages the weapon. A stabilizer arm extends downwardly from a left side of the base, with a contoured foot attached to a lower end of the stabilizer arm, and engages the weapon.

14 Claims, 4 Drawing Sheets

ACCESSORY RAIL KIT

STATEMENT OF GOVERNMENT INTEREST

The invention described herein may be manufactured, used, and licensed by or for the U.S. Government for governmental purposes without payment of any royalties thereon.

BACKGROUND

The present invention relates to a rail for mounting accessories to a firearm.

Various accessories are available to assist the user of firearms, including those used in the military and law enforcement and by hunters. These accessories may include, for example, scopes, sights, illumination devices, range finders, laser devices, night vision and thermal devices, sensors, communication devices, and video cameras. Different situations and conditions may require the use of different accessories. For example, different kinds of scopes may be used in different lighting conditions such as daylight or night, and in different operational conditions such as target shooting, field hunting, or in various conditions related to military combat. Thus, it is desirable to be able to quickly remove an auxiliary device from a firearm to replace it with another device for a specific situation, to replace a failed device, or to reposition the device on the weapon to a more optimal position.

The auxiliary devices may be mounted directly to the firearm or indirectly on a mounting platform secured to the weapon. An example of a mounting platform is the Picatinny rail described in Military Standard MIL-STD-1913. A Picatinny rail is a bracket that is typically a rail extending along the upper surface of a gun barrel, and having a series of ribs interspersed with slots or channels providing lateral stability. Accessories are usually mounted by seating them onto the slots and securing them with a rail-grabber or clamp for vertical and axial stability. Another example is the Weaver rail, which is similar to the Picatinny rail, but used on civilian rifles and handguns.

The rail must be securely attached to the firearm. Otherwise movement of the rail may cause an accessory to move out of alignment and affect accuracy of the firearm. Stability is usually achieved by modifying the weapon to accommodate the rail by, for example, drilling holes in the barrel to receive mounting screws, which can affect the performance of the firearm.

Also, conventional rails can have many different components that make attaching and detaching the rail burdensome in the field, especially in a combat situation. These components often require tools for assembly and screws that can become lost.

Therefore, it is desirable to provide a rail that is easily and securely attachable and detachable to a firearm, without the need to modify the firearm, to provide a user-configurable firearm that can be adapted to meet a variety of operational and environmental requirements.

SUMMARY

The present invention solves or ameliorates the above-described problems and deficiencies by adapting a rail such as a Picatinny or Weaver rail so that it can be removably attached to a weapon or firearm without the use of tools under a variety of day and night conditions.

In accordance with an embodiment of the invention, there is provided an accessory rail kit that is removably mountable on a weapon. The accessory rail kit includes an upper accessory rail extending parallel to a round of the weapon. The upper accessory rail has a front end, a back end, and an upper accessory mounting surface. A base supports the upper accessory rail. A front structural support extends downwardly from the base, proximate to the front end of the upper accessory rail, that engages the weapon at a first point. A back structural support extends downwardly from the base, proximate to the back end of the upper accessory rail, that engages the weapon at a second point. A side rail support extends downwardly from a right side of the base that engages the weapon at a third point. A stabilizer arm extends downwardly from a left side of the base, with a contoured foot attached to a lower end of the stabilizer arm, that engages the weapon at a fourth point.

In accordance with another embodiment of the invention, there is provided an accessory rail kit that is removably mountable on a weapon. The accessory rail kit includes an upper accessory rail extending parallel to a round of the weapon, with a front end, a back end, and an upper accessory mounting surface. A base supports the upper accessory rail. A front structural support extends downwardly from the base, proximate to the front end of the upper accessory rail, and engages the weapon at a first point. A back structural support extends downwardly from the base, proximate to the back end of the upper accessory rail, and engages the weapon at a second point. A side rail support extends downwardly from a right side of the base that engages the weapon at a third point. A stabilizer arm extends downwardly from a left side of the base, with a contoured foot attached to a lower end of the stabilizer arm, and engages the weapon at a fourth point. A side accessory rail attaches to the side rail support, extends parallel to the upper accessory rail, and has a side accessory mounting surface facing outwardly from the right side of the base.

In accordance with another embodiment of the invention, there is provided a method of removably mounting an accessory rail kit onto a weapon. The accessory rail kit includes an upper accessory rail, a base supporting the upper accessory rail, a front structural support extending downwardly from the base at a first end, a back structural support extending downwardly from the base at a second end, a side rail support extending downwardly from a right side of the base, and a stabilizer arm extending downwardly from a left side of the base and having a contoured foot attached to a lower end of the stabilizer arm. The method includes positioning a first self-retaining fastener in a hole in the front structural support and connecting it to a first attachment point on the weapon without using tools. A second self-retaining fastener is positioned in a hole in the back structural support and connected to a second attachment point on the weapon without using tools. A third self-retaining fastener is positioned in a hole in the side rail support and rests on a third attachment point on the weapon without using tools.

BRIEF DESCRIPTION OF THE DRAWINGS

Various aspects and advantages of the invention will become apparent from the following detailed description, taken in conjunction with the accompanying drawings. The drawings are not necessarily drawn to scale. In the drawings.

DETAILED DESCRIPTION

Rails can be designed for many different types of firearms and weapons such as hunting rifles, shotguns, machine guns, cross bows, recoilless rifles, etc. Military weapons are typically produced with factory manufactured iron sights, rather than accessory rails, and so are not originally designed for or manufactured for use with an accessory rail. An accessory rail for a particular military weapon must either be adapted to the structure of the firearm or the firearm must be adapted to accommodate the rail. The embodiments below describe a rail that is designed to accommodate a weapon without modifying the weapon.

Figure 1:
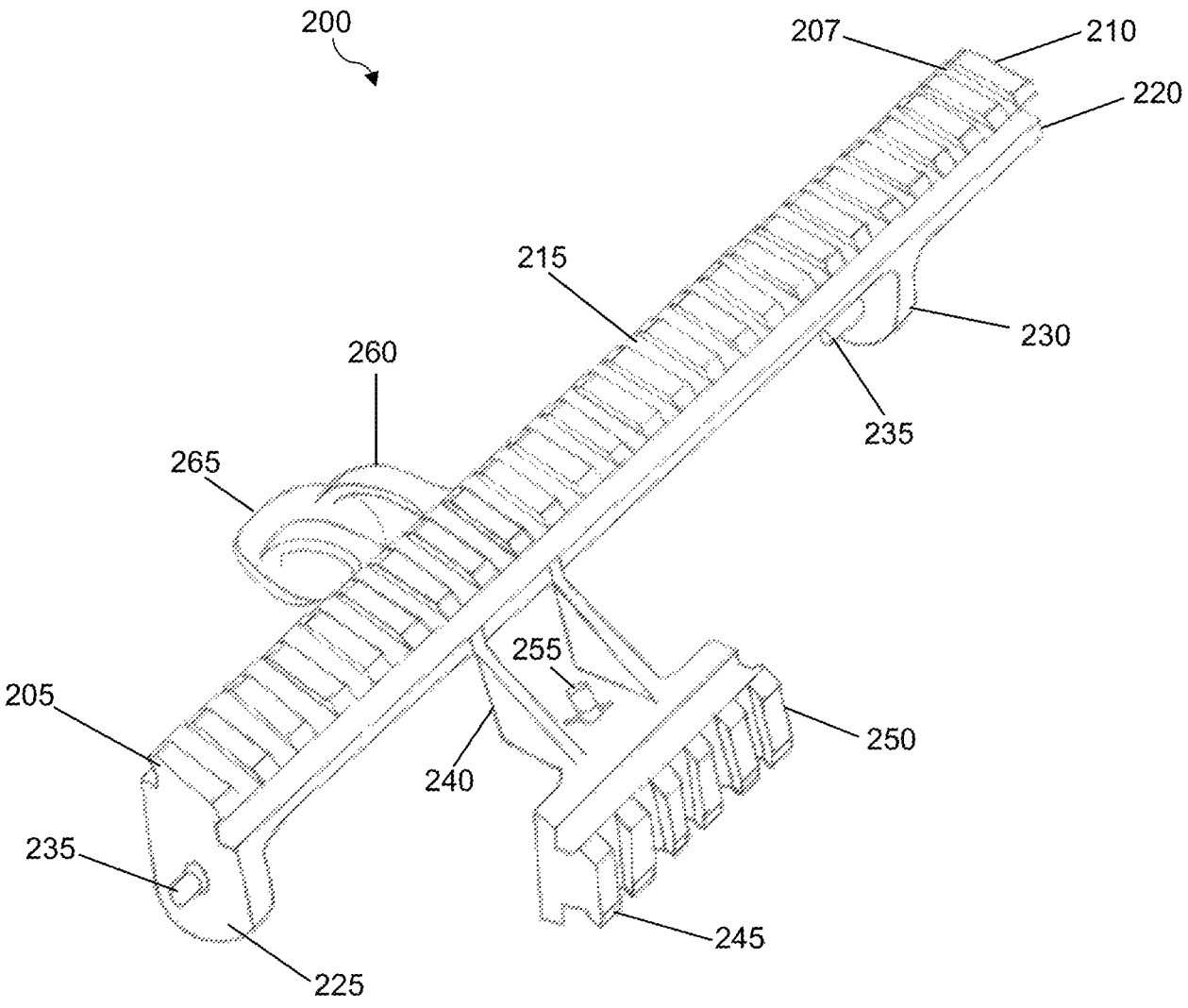
FIG. 1 is a perspective view of an accessory rail kit in accordance with an illustrative embodiment.
Figure 2:
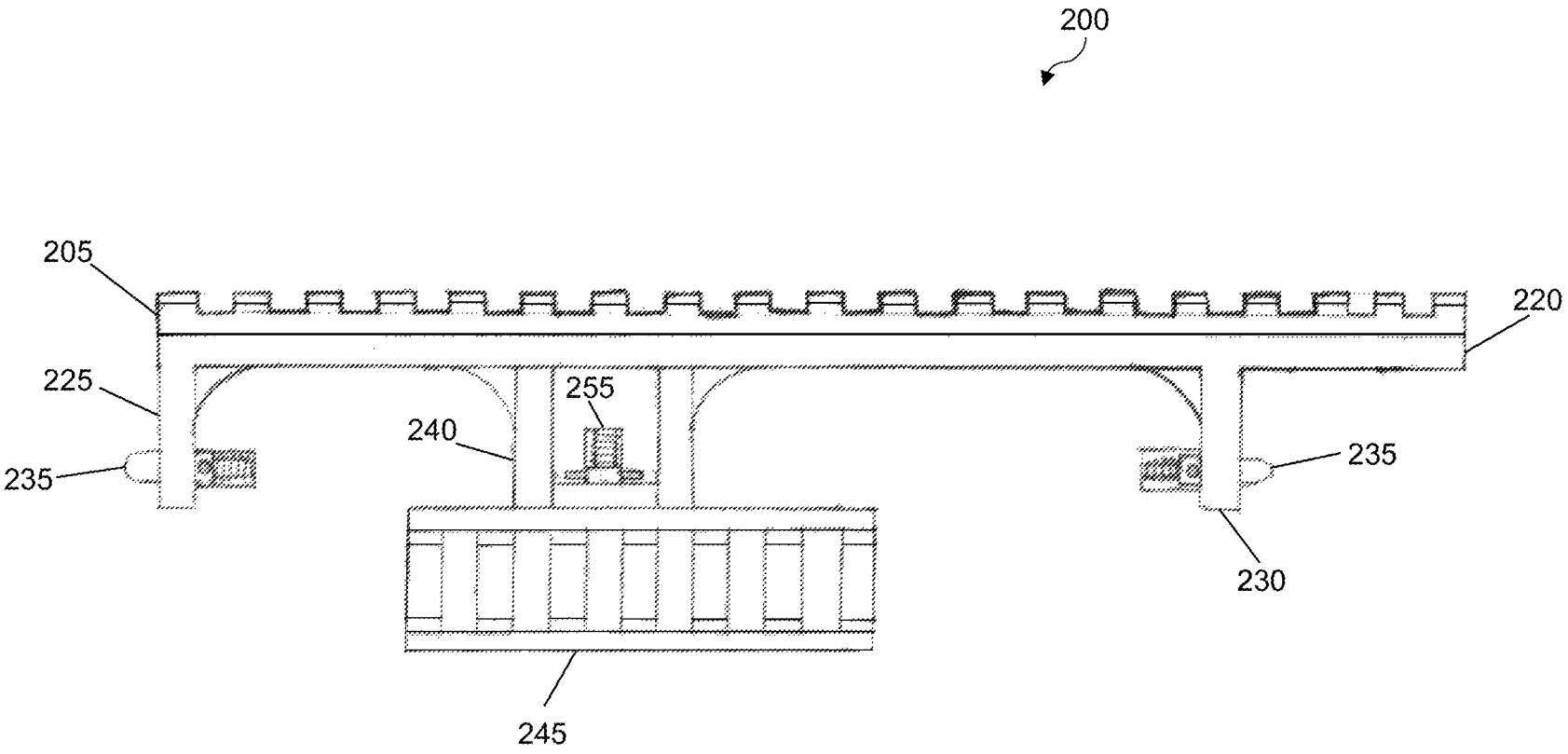
FIG. 2 is a side view of the accessory rail kit of FIG. 1 in accordance with an illustrative embodiment.
Figure 3:
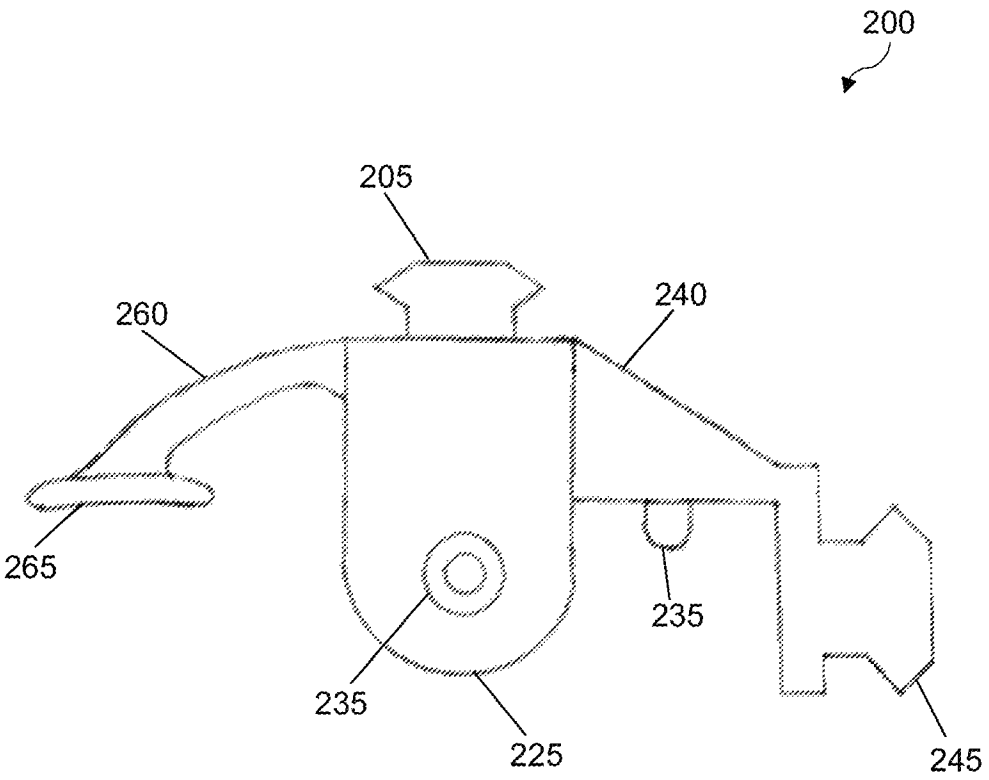
FIG. 3 is a front view of the accessory rail kit of FIG. 1 in accordance with an illustrative embodiment.
Figure 4:
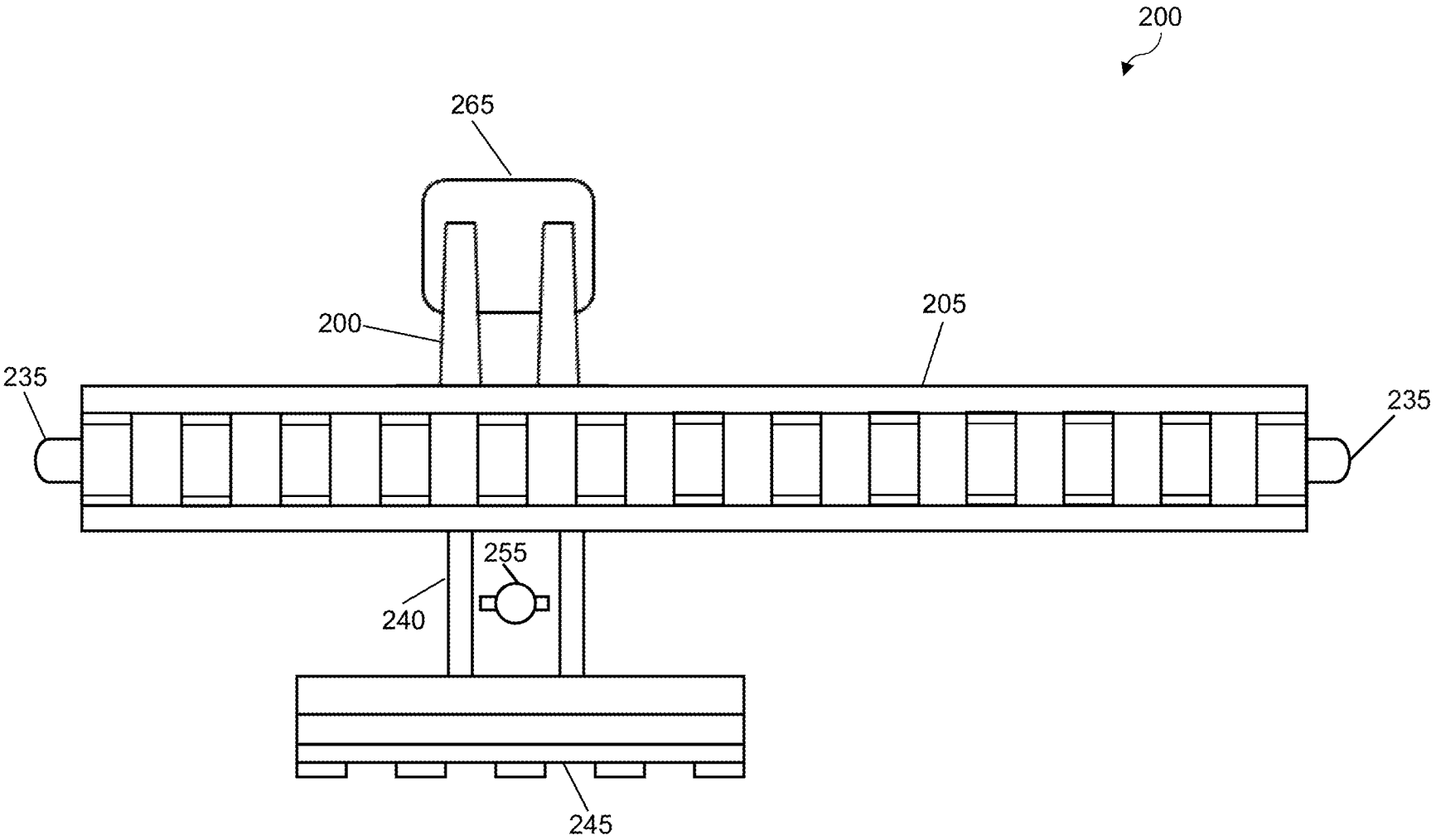
FIG. 4 is a top view of the accessory rail kit of FIG. 1 in accordance with an illustrative embodiment.

An exemplary embodiment of an accessory rail kit 200 for a weapon is shown in FIGS. 1 through 4. The accessory rail kit 200 attaches to components of the weapon such as a round, barrel, or forestock (hereinafter referred to as a "round"). The accessory rail kit 200 includes an upper accessory rail 205 having an upper accessory mounting surface 207 with a plurality of equally spaced transverse ribs 210 extending along a length of the upper accessory rail 205 that form slots 215 in the top of the upper accessory rail 205. The upper accessory rail 205 can be built to MIL-STD-1913 "Picatinny Rail" and Weaver rail specifications and is used to mount accessory devices (not shown) with MIL-STD-1913 compatible rail grabbers (not shown) to the accessory rail kit 200. A base 220 supports the upper accessory rail 205. A front structural support 225 and a back structural support 230 extend downwardly from the base 220 and are attached to the weapon.

Fasteners 235, such as self-retaining fasteners, are integrally positioned in holes in the front and back structural supports 225 and 230 to allow an operator to quickly mount and dismount the accessory rail kit 200 to and from the weapon using finger, mechanical, or pryotechnic pressure upon the fasteners 235 directly or upon the front or back structural supports 225, 230 attached to the fasteners 235 to retract the fasteners 235, allowing insertion or withdrawal from corresponding attachment points on the weapon. In the embodiment shown in FIGS. 1 through 4, the fasteners 235 are spring guide pins that are tapered with cylindrical tips, but other types of spring guide pins may be used. The addition of the spring guide pins 235 also provides additional shock absorption for the accessory rail kit 200. Alternatively, the fasteners 235 may be constructed with a push button mechanism similar to that in retractable ball point pens that extends and retracts a plunger, when depressed with finger pressure, to attach the accessory rail kit 200 to the weapon. In another embodiment, the fasteners 235 may be constructed with a pull ring similar to a key ring that retracts and extends the plunger when the ring is pulled and released to attach the accessory rail kit 200 to the weapon.

The attachment points on the weapon can be pre-drilled holes, grooves, crevices, or other openings or weapon structure such that the fasteners 235 can be securely attached. For example, hinge holes for a stowed sight assembly may be used. Thus, the rail accessory kit 200 does not permanently modify the weapon and can be removably attached without the need for tools or weapon modification.

A side rail support 240 extends downwardly from the right side of the base 220 and connects to a side accessory rail 245 that has a side accessory mounting surface 250 that faces outwardly from the right side of the base 220. The side accessory rail 245 can also be built to MIL-STD-1913 Picatinny rail and Weaver rail specifications and allows for mounting of accessories, which are compatible with the respective Picatinny or Weaver rail design specification, such as an aiming laser, remote, sensor, or additional optic. A stabilization fastener 255, which may also be a spring guide pin, is integrally positioned in a hole in the side rail support 240 and attaches to or rests against the weapon round or other weapon structure, such as the stowed sight assembly. A stabilizer arm 260 extends downwardly from the left side of the base 220, and terminates at a contoured foot 265. The contoured foot 265 rests on the weapon round. The contoured foot 265 is shaped to conform to the shape of the weapon round.

The fasteners 235, the stabilization fastener 255, and the stabilizer arm 260 with the contoured foot 265 serve to connect or engage the accessory rail kit 200 to the weapon. The fasteners 235 prevent the accessory rail kit 200 from moving in the longitudinal direction, and the stabilization fastener 255 and the stabilizer arm 260 with the contoured foot 265 prevent axial rotation. The stabilization fastener 255 imparts axial tension on the accessory rail kit 200 when mounted to the weapon to stabilize the roll of the rail accessory kit 200 about the long axis while providing shock absorption for the accessory rail kit 200 and mounted accessory devices. The stabilizer arm 260 with the contoured foot 265 imparts axial tension on the accessory rail kit 200 that is equal to and opposite from that exerted by the stabilization fastener 255.

In an alternative embodiment, an additional stabilization fastener may replace or be added to the contoured foot 265 to provide axial shock absorption for the accessory rail kit 200. In another embodiment, magnetic fasteners may be used instead of, or in addition to, the fasteners 235 and the stabilization fastener 255 to lock or more firmly attach the fasteners 235 and the stabilization fastener 255 by requiring additional finger pressure to overcome the magnetic attractive force, which reduces the possibility of an accidental disengagement of the accessory rail kit 200 from the weapon.

In another embodiment, the orientation of the fasteners 235 is reversed to allow the design to accommodate attachment points located interior to the front structural support 225 and the back structural support 230. For example, the fastener 235 on the front structural support 225 can point toward the interior of the accessory rail kit 200 rather than away from it. The resulting configuration provides a C-clamp like functionality.

No machining modifications to the weapon are required in order to attach the accessory rail kit 200 described herein. Further, the accessory rail kit 200 provides at least two points of attachment, plus the stabilizer arm 260 with the contoured foot 265, which are spaced apart from each other, thus improving the stability and performance of the accessory rail kit 200 as a platform for various accessory devices.

According to one illustrative embodiment, the upper and side accessory rails 205 and 245 may have several dimensions that are the same as the conventional Picatinny rail, including a slot width spacing of approximately 0.206 inches (5.23 mm), spacing between slot centers of approximately 0.394 inches (10.01 mm), and a slot depth of approximately 0.118 inches (3.00 mm). In the illustrative embodiment, the length of the upper accessory rail 205 is approximately 10.05 inches (255.27 mm), and the length of the side accessory rail 245 is approximately 2.167 inches (55.05 mm).

The locations and dimensions of the accessory rail kit 200 components can be varied to correspond to pre-existing manufactured mounting holes or attachment points on different types of military weapons and civilian firearms. In addition, the structural supports can be varied in size, spacing, and number to accommodate changes in accessory mass, length, and center of gravity.

The accessory rail kit 200 can be constructed using natural, synthetic, or metallic materials or composites (e.g., fiberglass, nylon, etc.), and manufactured using, for example, casting, milling, additive manufacturing, or injection molding. For use on a military weapon, the accessory rail kit should weigh as little as possible. In one embodiment, the accessory rail kit 200 was constructed from VeroCyan™ and VeroWhitePlus™ additive manufacturing materials from Stratasys, Ltd. of Eden Prairie, Minn., and weighed approximately 4.4 oz.

Various types of fasteners 235 and stabilization fasteners 255 may be used, such as spring guide pins and locking guide pins. Also, one of the fasteners 235 for the front structural support 225 or the back structural support 230 can be removed and a similar pin structure molded into the same position, while the remaining fastener is retractable, which reduces complexity of the design, increases reliability, and facilitates easier mounting and dismounting of the accessory rail kit 200.

In another alternative embodiment, a lanyard such as a rope, wire, or cable can be used to connect the accessory rail kit 200 to the weapon, to another device such as a tripod mount (not shown), or to a person. The lanyard can be connected to the accessory rail kit 200 via an existing built-in hole or gap, or a hole can be drilled into the base 220, the front structural support 225, the back structural support 230, the side rail support 240, the side accessory mounting surface 250, or the contoured foot 265 so that the accessory rail kit 200 does not become lost or damaged in the event it becomes detached unexpectedly from the weapon.

There are several advantages to the accessory rail kit 200, including the following:

(a) The accessory rail kit allows quick and easy mounting and dismounting in the field, even in adverse weather and operating conditions, with or without personal protective equipment such as gloves, without tools or modification to the weapon round, resulting in no degradation to the weapon's capabilities.

(b) The light weight of the accessory rail kit allows larger and heavier sights with increased capabilities to be mounted.

(c) The low profile design accommodates existing storage containers for weapons and accessories so that a weapon round or accessory can be stored with a mounted rail kit ready for employment.

(d) The accessory rail kit does not use screws that can work free and become lost. Also, vibrations of the weapon will not cause the fasteners to work free, thus the accessory rail kit remains stable.

(e) The tapered guide pins with cylindrical tips self-center the accessory rail kit to the weapon round, increasing boresight consistency while preventing accidental detachment of the accessory rail kit from the weapon due to external forces such as picking up the weapon by the rail.

(f) Embodiments using one retractable guide pin 235 minimize complexity and increase reliability.

While the foregoing written description of the invention enables one of ordinary skill to make and use what is described herein, those of ordinary skill will understand and appreciate the existence of variations, combinations, and equivalents of the disclosed embodiment and method. The invention should therefore not be limited by the above description, but by all embodiments and methods within the scope and spirit of the invention as disclosed.

What is claimed is:

1. An accessory rail kit removably mountable on a weapon, comprising:

an upper accessory rail extending parallel to a round of a weapon, and having a front end, a back end, and an upper accessory mounting surface;

a base supporting the upper accessory rail;

a front structural support extending downwardly from the base, proximate to the front end of the upper accessory rail, that engages the weapon at a first point;

a back structural support extending downwardly from the base, proximate to the back end of the upper accessory rail, that engages the weapon at a second point;

a side rail support extending downwardly from a right side of the base that engages the weapon at a third point;

a stabilizer arm extending downwardly from a left side of the base, with a contoured foot attached to a lower end of the stabilizer arm, that engages the weapon at a fourth point; and a side accessory rail attached to the side rail support, extending parallel to the upper accessory rail, and having a side accessory mounting surface facing outwardly from the right side of the base.

2. The accessory rail kit of claim 1, wherein the accessory rail kit does not permanently modify the weapon and is constructed from natural, plastic, metal, or composite materials using additive manufacturing, milling, injection molding, casting, or forging.

3. The accessory rail kit of claim 1, wherein the contoured foot engages the weapon by resting on the weapon round.

4. The accessory rail kit of claim 1, further comprising a plurality of fasteners positioned in holes in the front and back structural supports and removably engaging corresponding attachment points on the weapon round to secure the accessory rail kit to the weapon, allowing an operator to quickly mount and dismount the accessory rail kit to and from the weapon round without the use of tools by using finger pressure to retract the fasteners.

5. The accessory rail kit of claim 4, wherein the fasteners are tapered self-retaining spring guide pins with cylindrical tips that provide shock absorption for the accessory rail kit and accessories mounted thereon.

6. The accessory rail kit of claim 4, wherein one of the fasteners for the front structural support or the back structural support is molded into the front or back structural support.

7. The accessory rail kit of claim 4, wherein the fasteners have a push button mechanism that extends and retracts a plunger, when depressed using finger pressure, to engage the weapon.

8. The accessory rail kit of claim 4, wherein the fasteners are magnetic and serve to lock the fasteners, requiring finger pressure to overcome a magnetic attractive force.

9. The accessory rail kit of claim 4, wherein an orientation of the fasteners is reversed to accommodate attachment points located interior to the front and back structural supports.

10. The accessory rail kit of claim 1, further comprising a stabilization fastener positioned in a hole in the side rail support and removably engaging a corresponding attachment point on the weapon, the stabilization fastener imparting axial tension on the accessory rail kit to stabilize a roll of the accessory rail kit about a long axis while providing shock absorption for the accessory rail kit and accessories mounted thereon, and the stabilizer arm with the contoured foot imparting axial tension on the accessory rail kit that is equal to and opposite from that exerted by the stabilization fastener.

11. The accessory rail kit of claim 10, wherein the stabilization fastener is a spring guide pin or a locking guide pin.

12. The accessory rail kit of claim 1, further comprising a lanyard having a first end and a second end, the first end connected to the accessory rail kit and the second end connected to the weapon or to a person to prevent the accessory rail kit from becoming lost or damaged if it becomes unexpectedly detached from the weapon.

13. A method of removably mounting an accessory rail kit onto a weapon, the accessory rail kit having an upper accessory rail, a base supporting the upper accessory rail, a front structural support extending downwardly from the base at a first end, a back structural support extending downwardly from the base at a second end, a side rail support extending downwardly from a right side of the base, and a stabilizer arm extending downwardly from a left side of the base and having a contoured foot attached to a lower end of the stabilizer arm, the method comprising:

positioning a first self-retaining fastener in a hole in the front structural support and connecting it to a first attachment point on the weapon without using tools;

positioning a second self-retaining fastener in a hole in the back structural support and connecting it to a second attachment point on the weapon without using tools;

positioning a third self-retaining fastener in a hole in the side rail support and resting it on a third attachment point on the weapon without using tools; and attaching a side accessory rail to the side rail support so that it extends parallel to the upper accessory rail and has a side accessory mounting surface facing outwardly from the right side of the base.

14. The method of claim 13, further comprising positioning the stabilizer arm so that the contoured foot rests on the weapon at a fourth attachment point, without using tools.

* * * * *